United States Patent [19]

Tsuchida et al.

[11] Patent Number: 4,497,722

[45] Date of Patent: Feb. 5, 1985

[54] COMPOSITION FOR PLASTIC MAGNETS

[75] Inventors: Michinori Tsuchida; Tokuji Abe, both of Saitama; Hajime Kitamura, Chiba, all of Japan

[73] Assignee: Shin-Etsu Chemical Co., Ltd., Tokyo, Japan

[21] Appl. No.: 626,742

[22] Filed: Jul. 2, 1984

[30] Foreign Application Priority Data

Jul. 4, 1983 [JP] Japan ..... 58-121420
Aug. 17, 1983 [JP] Japan ..... 58-149910

[51] Int. Cl.[3] ..... H01F 10/02

[52] U.S. Cl. ..... 252/62.54; 428/539.5; 428/900

[58] Field of Search ..... 252/62.54

[56] References Cited

U.S. PATENT DOCUMENTS 3,859,130 1/1975 Parker et al. ..... 252/62.54
4,018,968 4/1977 Neumann et al. ..... 252/62.54
4,020,236 4/1977 Aonuma et al. ..... 252/62.54

*Primary Examiner*—Arthur P. Demers
*Attorney, Agent, or Firm*—Toren, McGeady and Stanger

[57] ABSTRACT

The plastic magnet composition provided by the invention comprises a thermoplastic resin as a binder and a powder of a metallic or alloy-type magnet which is coated on the particle surface with a phosphorus-containing compound having at least one phosphorus-to-oxygen linkage in a molecule such as phosphoric acid and related compounds. By virtue of the surface coating, the magnet powder is freed from the degradation by air oxidation and the danger of ignition in the molding process so that plastic magnets of high performance can be readily manufactured with safety. The advantages of the coating layer are further increased when the coating layer is formed of a combination of the phosphorus-containing compound and an organic dye compound. An overcoating on the thus coated magnet powder with an organopolysiloxane has an effect of increased lubricity.

8 Claims, No Drawings

COMPOSITION FOR PLASTIC MAGNETS

BACKGROUND OF THE INVENTION

The present invention relates to a composition capable of giving a high-performance plastic magnet having excellent magnetic properties as well as thermal properties resistant against air oxidation.

The permanent magnets as a major current include so-called sintered magnets prepared by the powder metallurgical techniques and cast magnets by casting a molten alloy into a mold. One of the serious problems in these magnets is that these magnet materials are not suitable for working into a very complicate form so that permanent magnets prepared by precision working are unavoidably very expensive. The distribution of magnetism in the permanent magnet of these types cannot be so uniform as desired. When a magnet with radial anisotropy or multipolar anisotropy is desired and prepared by these techniques, the magnet sometimes fractured so that yield of acceptable products usually cannot be high.

So-called plastic magnets have been developed to overcome these disadvantages and problems in the sintered and cast magnets. In the early stage of the development of plastic magnets, the powdery magnetic materials used to be bonded with a plastic polymer were mainly ferrite-based ones in view of the inexpensiveness of these magnetic materials. In compliance with the recent demand for more powerful and small-size or light-weight plastic magnets, the ferrite-based magnetic powders are under continuous replacement with metallic or alloy-type magnetic materials of which the rare earth-cobalt type magnetic materials are the most promising by virtue of their outstandingly high magnetic performance.

Although the magnetic performance of the rare earth-cobalt type magnet powder is unquestionably superior to that of the ferrite-based magnetic materials, these metallic magnet powders have a difficult problem when used as the base material of plastic magnets. That is, since molding of plastic magnets is performed usually at a relatively high temperature of 200° to 250° C. or higher so that the metallic magnet powder is rapidly oxidized in air at such a high temperature resulting in a great decrease of the magnetic properties. In some cases, there is even a danger of ignition of the magnet powder. The remedial means usually undertaken to overcome these problems are as follows.

(1) The procedure for the fabrication of plastic magnets is performed in an atmosphere of an inert or non-oxidizing gas. This method is considerably effective in preventing the oxidation of the magnet powder but complete prevention of air oxidation is rather difficult without decrease in the productivity and increase in the production cost.

(2) The magnet powder is subjected to a surface treatment in advance with certain coating agents such as titanium-containing or silane compounds. Such a surface coating is of course effective to prevent air oxidation of the magnet powder although complete prevention of air oxidation is also a very difficult matter. In particular, this method is almost ineffective when the processing temperature of the plastic magnet is 300° C. or higher.

(3) The plastic polymer as the binder of the magnet powder is selected from those moldable at a relatively low temperature. This measure is of course effective in preventing air oxidation of the magnet powder so much to the extent of the decrease in the processing temperature. On the other hand, the upper limit of the temperature at which the plastic magnet is usable is naturally low and the magnetic properties of such a plastic magnet disadvantageously change or deteriorate relatively rapidly in the lapse of time.

(4) The loading amount of the magnet powder, i.e. the weight ratio of the magnet powder to the plastic polymer, in the plastic magnet is decreased. This measure, of course, cannot be undertaken when a high-performance plastic magnet is desired since the magnetic properties of a plastic magnet are directly affected by the decrease of the loading amount.

SUMMARY OF THE INVENTION

It is therefore an object of the present invention to provide a composition capable of being molded into a high-performance plastic magnet loaded with a metallic magnet powder or, in particular, a powder of a rare earth-cobalt type permanent magnet alloy free from the above described problems and disadvantages in the conventional plastic magnets.

Another object of the invention is to provide a method for the preparation of a composition moldable into a high-performance plastic magnet free from the problems in the conventional plastic magnets on the base of a metallic magnet powder or, in particular, powder of a rare earth-cobalt type magnet alloy.

Thus, the plastic magnet composition of the invention comprises a metallic magnet powder having a coating layer on the surface formed of a phosphorus-containing compound having at least one phosphorus-to-oxygen linkage in a molecule and a plastic polymer uniformly blended with the magnet powder.

Further improvements can be obtained when the above mentioned coating layer on the surface of the magnet powder is formed of a binary combination of the above mentioned phosphorus-containing compound and an organopolysiloxane compound or an organic dye compound. It is of course optional that the coating layer on the surface of the magnet powder is formed of a ternary combination of the phosphorus-containing compound, organic dye compound and orgnopolysiloxane compound.

Accordingly, the method of the present invention for the preparation of a plastic magnet composition comprises coating the surface of a metallic magnet powder with a phosphorus-containing compound having at least one phosphorus-to-oxygen linkage in a molecule, optionally, together with an organic dye compound and/or an organopolysiloxane compound, and uniformly blending the thus surface-coated metallic magnet powder with a plastic polymer.

DETAILED DESCRIPTION OF THE PREFERRED EMBODIMENTS

As is understood from the above description, the most essential feature of the invention is the surface coating of the metallic magnet powder with a specific phosphorus-containing compound, optionally, together with an organic dye compound and/or an organopolysiloxane compound. This surface coating is quite effective in preventing the air oxidation of the magnet powder even at a high temperature encountered in the processing of the plastic magnet to retain the excellent magnetic characteristics inherent to the metallic magnet such as the rare earth-cobalt type ones. Following is a summary of the advantages obtained by the above described present invention.

(1) The mtallic magnet powder thus coated on the surface with the phosphorus-containing compound or a binary or ternary combination including the same is quite stable even at a high temperature of 300° C. or higher in an atmosphere of air to be freed from the danger of degradation by surface oxidation or ignition so that the plastic magnet fabricated with such a surface-coated magnet powder has very high magnetic properties.

(2) The selection of the plastic polymer blended with the magnet powder is freed from the limitations in respect of the molding temperature. For example, so-called engineering plastics which should be molded at 200° C. or higher can be used without particular problems and plastic magnets highly loaded with the magnet powder can be obtained by the conventional molding procedure such as injection molding and extrusion molding. Such a plastic magnet is usable at high temperatures and very reliable with a very small change in the magnetic properties in the lapse of time.

(3) High-performance plastic magnets with radial anisotropy or multipolar anisotropy can readily be fabricated.

(4) Monolithically molded plastic magnets with an insert or plastic magnets of complicated form can readily be fabricated requiring no particular finishing works so that the production cost for the plastic magents can be greatly reduced.

(5) High uniformity of the magnetic properties is ensured in the thus prepared plastic magnets having high resistance against impact which is a favorable condition when the plastic magnet is used in a magnetic relay, buzzer and the like instruments used under vibration or mechanical shocks.

(6) The magnet powder is freed, as is mentioned above, from the disadvantage of degradation by the surface oxidation and the danger of ignition in the course of fabrication into plastic magnets even at an elevated temperature so that the productivity can greatly be improved and the production line is freed from the safety problem. In addition, the magnetic properties retained in the fabrication facilitate reclaiming and reuse of scrapped pieces of plastic magnets without the disadvantage of decreased magnetic performance.

The above described principle of the present invention and the advantages obtained thereby are not limited to a specific type of the metallic or alloy-type permanent magnets although the most remarkable results can be obtained when the metallic magnet is a rare earth-cobalt type one. This type of the permanent magnets is well known in the art of magnetic materials and the magnet is formed of an alloy mainly composed of a rare earth element and cobalt although some of the rare earth-cobalt magnets may additionally contain copper and other transition metal elements such as iron. The alloy composition of the rare earth-cobalt magnets is typically expressed by the formula of $RCo_5$ or $R(Co,Cu,Fe,M)_z$, in which R is one or a combination of the rare earth elements, such as samarium, cerium, praseodymium, neodymium, terbium, yttrium and the like, M is one or a combination of the elements belonging to the Fourth to Seventh Groups of the Periodic Table including titanium, zirconium, hafnium, niobium, tantalum, molybdenum, chromium, tungsten, manganese and the like and z is a positive number, usually, in the range from 5 to 9.

The metallic magnet powder should preferably have a particle size distribution in the range from 0.1 to 10 μm when the magnet is of the type of $RCo_5$. When the powder is coarser than above, the resultant plastic magnet may have a somewhat decreased coercive force in addition to the increased variation in the magnetic properties from piece to piece while a magnet powder finer than above is more susceptible to air oxidation due to the increased surface area so that specific care must be taken in handling.

The powder of a rare earth-cobalt magnet of the type of the formula $R(Co,Cu,Fe,M)_z$ is prepared by pulverizing the alloy crystallized in the preparation of a spinodal magnet alloy followed by the powder metallurgical processing including molding in a magnetic field, sintering and aging to give a magnet body which is again pulverized into a powder having desired particle size distribution. The particle size distribution is not particularly limitative and should be determined in consideration of the easiness of handling and the performance of the resultant plastic magnet. For example, high loading with the magnet powder can be achieved by using a combination of a first powder having a particle size distribution as fine as possible and a second powder having a somewhat coarser particle size distribution. When a multipolar, radially anisotropic plastic magnet is desired, the particle size of the magnet powder should preferably not exceed one tenth of the dimension of each pole.

The phosphorus-containing compound to form the coating layer on the surface of the magnet powder should have at least one phosphorus-to-oxygen linkage in a molecule and exemplified by phosphoric acid and related inorganic compounds such as phosphorous acid, hypophosphorous acid, sodium dihydrogenphosphate, disodium hydrogenphosphate, sodium phosphate, potassium dihydrogenphosphate, dipotassium hydrogenphosphate, potassium phosphate, sodium phosphite, sodium hypophosphite, potassium phosphite, potassium hypophosphite, sodium pyrophosphate, sodium hydrogenpyrophosphate, sodium hydrogenmetaphosphate, sodium tripolyphosphate, potassium pyrophosphate, potassium hydrogenpyrophosphate, potassium hydrogenmetaphosphate, potassium tripolyphosphate, sodium hexametaphosphate, potassium hexametaphosphate and the like and organic phosphorus-containing compounds such as phytic acid, sodium phytate, potassium phytate, tricresyl phosphate, tris(nonylphenyl)-phosphite, isopropyl tris(dioctyl pyrophosphate)titanate, tetraisopropyl bis(dioctyl phosphite)titanate, tetraoctyl bis(ditridecyl phosphite)titanate, bis(dioctyl pyrophosphate)hydroxyacetate titanate, bis(diocty pyrophosphate)ethylene titanate, tetra(2,2-diallyloxy methyl-1-butyl) bis(di-tridecyl)phosphite titanate and the like. These phosphorus-containing compounds may be used either singly or as a combination of two kinds or more according to need.

The metallic magnet powder can readily be coated with the above named phosphorus-containing compound by dipping the powder in a solution containing about 0.01 to 5% by weight of the phosphorus-containing compound or spraying the same solution to the powder to uniformly wet the surface followed by drying at a temperature from room temperature up to about 150° C. The solvent to dissolve the phosphorus-containing compound should of course be selected in consideration of the solubility behavior of the compound in the solvent. Suitable solvents include water and organic solvents such as alcoholic solvents, aliphatic hydrocarbon solvents, aromatic hydrocarbon solvents, halogenated aliphatic hydrocarbon solvents, ketone solvents, ether solvents, ester solvents and the like. It is of course optional to use a solvent mixture composed of two kinds or more of the above named solvents.

The coating amount of the above defined phosphorus-containing compound on the surface of the magnet powder should preferably be in the range from 0.01 to 5% by weight or, more preferably, from 0.05 to 1% by weight based on the magnet powder. When th coating amount is smaller than above, no sufficient effect of oxidation prevention can be obtained while an excessively large coating amount over the above range may have no particular additional advantages rather with disadvantages in respect of the decreased flowability of the coated powder to be a drawback against the increase of loading of the plastic magnet with the coated magnet powder as a consequence of the decreased relative proportion of the plastic polymer as a binder.

As is mentioned before, the coating layer on the surface of the magnet powder may be formed of a binary combination of the above named phosphorus-containing compound and an organopolysiloxane compound when further improvements are desired in the oxidation prevention of the magnet powder as well as in the lubricating effect exhibited in the molding process of the plastic magnet.

The organopolysiloxane compound usable in the above purpose is not particularly limitative in respects of the molecular structure and type including so-called silicone fluids, silicone gums and silicone resins as well as various kinds of modified organopolysiloxanes. The molecular weight of the organopolysiloxane compound is also not limitative ranging from a relatively low to a very high molecular weight.

The organopolysiloxane compound combined with the phosphorus-containing compound can be used in several different ways. For example, the organopolysiloxane compound may be dissolved in the solution containing the phosphorus-containing compound and the magnet powder is uniformly wetted with the solution followed by drying. Alternatively, the magnet powder having been coated with the phosphorus-containing compound is subsequently subjected to the coating treatment with the organopolysiloxane compound either by dipping in or spraying with a solution containing the organopolysiloxane compound. At any rate, the use of an organopolysiloxane compound has an effect that the coating amount with the phosphorus-containing compound can be decreased.

The amount of the organopolysiloxane compound used in the binary coating with the phosphorus-containing compound may somewhat differ depending on the manner of its use. When the organopolysiloxane compound is dissolved in a solution together with the phosphorus-containing compound, the amount of the former in the solution is preferably in the range from 1 to 10 parts by weight per part by weight of the latter. When the coating treatment of the magnet powder with the organopolysiloxane compound follows the coating treatment with the phosphorus-containing compound, on the other hand, the coating amount of the former should preferably be in the range from 0.02 to 2% by weight based on the magnet powder.

The alternative binary combination of the materials for the coating layer on the magnet powder is a combination of the phosphorus-containing compound with an organic dye compound. Various types of organic dye compounds are suitable for the purpose including direct dyes, acid dyes, basic dyes, mordant dyes, sulfur dyes, vat dyes, disperse dyes, oil-soluble dyes and reactive dyes as well as fluorescent brightening agents. Particular examples of the dyes belonging to each of these classes are as follows.

Direct dyes: C.I. Direct Yellow 26; 28; 39; 44; 50; 86; 88; 88; 89; 98; and 100; C.I. Direct Orange 39; 51; and 107; C.I. Direct Red 79; 80; 81; 83; 84; 89; and 218; C.I. Direct Green 37; and 63; C.I. Direct Violet 47; 51; 90; and 94; C.I. Direct Blue 71; 78; 86; 90; 98; 106; 160; 194; 196; 202; 225; 226; and 246; C.I. Direct Brown 95; 106; 170; 194; and 211; C.I. Direct Black 19; 32; 51; 75; 94; 105; 106; 107; 108; 113; 118; and 146

Acid dyes: C.I. Acid Yellow 7; 17; 23; 25; 40; 44; 72; 75; 98; 99; 114; 131; and 141; C.I. Acid Orange 19; 45; 74; 85; and 95; C.I. Acid Red 6; 32; 42; 52; 57; 75; 80; 94; 111; 114; 115; 118; 119; 130; 131; 133; 134; 145; 168; 180; 184; 194; 198; 217; 249; and 303; C.I. Acid Violet 34; 47; and 48; C.I. Acid Blue 15; 29; 43; 45; 54; 59; 80; 100; 102; 113; 120; 130; 140; 151; 154; 184; 187; and 229; C.I. Acid Green 7; 12; 16; 20; 44; and 57; C.I. Acid Brown 39; and 301; C.I. Acid Black 2; 24; 26; 29; 31; 48; 52; 63; 131; 140; and 155

Basic dyes: C.I. Basic Yellow 11; 14; 19; 21; 28; 33; 34; 35; and 36; C.I. Basic Orange 2; 14; 21; and 32; C.I. Basic Red 13; 14; 18; 22; 23; 24; 29; 32; 35; 36; 37; 38; 39; and 40; C.I. Basic Violet 7; 10; 15; 21; 25; 26; and 27; C.I. Basic Blue 54; 58; and 60; C.I. Basic Black 8

Mordant dyes: C.I. Mordant Yellow; 1; 23; and 59; C.I. Mordant Orange 5; C.I. Mordant Red 21; 26; 63; and 89; C.I. Mordant Violet 5; C.I. Mordant Blue 1; 29; and 47; C.I. Mordant Green 11; C.I. Mordant Brown 1; 14; and 87; C.I. Mordant Black 1; 3; 7; 9; 11; 13; 17; 26; 38; 54; 75; and 84

Sulfur dyes: C.I. Sulfur Orange 1; and 3; C.I. Sulfur Blue 2; 3; 6; 7; 9; and 13; C.I. Sulfur Red 3; and 5; C.I. Sulfur Green 2; 6; 11; and 14; C.I. Sulfur Brown 7; and 8; C.I. Sulfur Yellow 4; C.I. Sulfur Black 1; C.I. Solubilized Sulfur Orange 3; C.I. Solubilized Sulfur Yellow 2; C.I. Solubilized Sulfur Red 7; C.I. Solubilized Sulfur Blue 4; C.I. Solubilized Sulfur Green 3; C.I. Solubilized Sulfur Brown 8

Vat dyes: C.I. Vat Yellow 2; 4; 10; 20; 22; and 23; C.I. Vat Orange 1; 2; 3; 5; and 13; C.I. Vat Red 1; 10; 13; 16; 31; and 52; C.I. Vat Violet 1; 2; and 13; C.I. Vat Blue 4; 5; and 6; C.I. Solubilized Vat Blue 6; C.I. Vat Blue 14; 29; 41; and 64; C.I. Vat Green 1; 2; 3; 8; 9; 43; and 44; C.I. Solubilized Vat Green 1; C.I. Vat Brown 1; 3; 22; 25; 39; 41; 44; and 46; C.I. Vat Black 9; 14; 25; and 57

Disperse dyes: C.I. Disperse Yellow 1; 3; and 4; C.I. Disperse Red 12; and 80: C.I. Disperse Blue 27

Oil soluble dyes: C.I. Solvent Yellow 2; 6; 14; 19; 21; 33; and 61; C.I. Solvent Orange 1; 5; 6; 37; 44; and 45; C.I. Solvent Red 1; 3; 8; 23; 24; 25; 27; 30; 49; 81; 82; 83; 84; 100; 109; and 121: C.I. Solvent Violet 1; 8; 13; 14; 21; and 27; C.I. Solvent Blue 2; 11; 12; 25; 35; 36; 55; and 73; C.I. Solvent Green 3; C.I. Solvent Brown 3; 5; 20; and 37; C.I. Solvent Black 3; 5; 7; 22; 23; and 123

Reactive dyes: C.I. Reactive Yellow 1; 2; 7; 17; and 22; C.I. Reactive Orange 1; 5; 7; and 14; C.I. Reactive Red 3; 6; and 12; C.I. Reactive Blue 2; 4; 5; 7; 15; and 19; C.I. Reactive Green 7; C.I. Reactive Black 1

Fluorescent brightening agents: C.I. Fluorescent Brightening Agent 24; 84; 85; 91; 162; 163; 164; 167; 169; 172; 174; 175; and 176

The coating treatment of the magnet powder with the binary combination of the phosphorus-containing compound and the organic dye compound is performed by uniformly wetting the magnet powder with a solution of both of these coating agents either by dipping therein or spraying therewith followed by drying, if necessary, with heating up to a temperature of 150° C. Alternatively, the coating treatment of the magnet powder with a solution of the phosphorus-containing compound is followed by the coating treatment with a solution containing the organic dye compound or vice versa.

The coating amounts of the phosphorus-containing compound and the organic dye compound should preferably be each in the range from 0.001 to 5% by weight or, more preferably, from 0.005 to 1% by weight based on the magnet powder.

It is further optional that the coating layer on the magnet powder is formed of a ternary combination of the phosphorus-containing compound, the organopolysiloxane compound and the organic dye compound so as to further increase the effect of oxidation prevention. The use of an organopolysiloxane compound is also effective to give a lubricating effect in the molding of the inventive composition into forms. The coating treatment with this ternary combination of the coating agents may be performed either by using a coating solution containing all of these three coating agents or the coating treatment with the organopolysiloxane compound may follow the coating treatment with the phosphorus-containing compound and the organic dye compound. The preferable coating amount of the organopolysiloxane in this case may be the same as that in the binary coating with the phosphorus-containing compound and the organopolysiloxane compound without the organic dye compound.

The plastic magnet composition of the present invention is obtained by uniformly blending the above described metallic magnet powder coated on the surface with a phosphorus-containing compound or a binary or ternary combination including the same with a plastic polymer. Usable plastic polymers include thermoplastic polymers in general without particular limitations exemplified by the general-purpose plastic resins such as polyethylene, polypropylene, polystyrene, polyvinyl chloride, acrylic resins and the like as well as so-called engineering plastics such as polyamide resins, polysulfone resins, polyphenylene sulfide resins, polyphenylene oxide resins, polyacetal resins, polycarbonate resins and the like.

One of the advantages obtained with the inventive plastic magnet composition is that a plastic magnet of unexpectedly high loading with the metallic magnet powder can readily be fabricated thereof reaching, in some favorable cases, about 95% by weight of the magnet powder in the overall magnet composition. On the contrary, plastic magnets having excellent magnetic properties can hardly be obtained in the prior art because the loading with the magnet powder cannot be so high due to the poor moldability of the composition and poor magnetic orientability of the magnet powder when the loading of the magnet powder is increased.

The molding method in which the inventive plastic magnet composition is shaped into pieces of plastic magnet is not particularly limitative and any conventional methods can be applicable including injection molding, compression molding, extrusion molding and the like.

According to the present invention, various advantages are obtained, some of which are: that the metallic magnet powder provided with the coating layer can be stored over a long period of time even without using an inert gas for the protecting atmosphere; that handling and processing of the magnet powder can be performed easily and with safety due to the absence of the air oxidation of the magnet powder; that plastic magnets of constant magnetic properties can be prepared in a high yield because the dangers of degradation by oxidation and ignition can be eliminated even when the metallic magnet powder comes to contact with air at a high temperature in the course of molding and fabrication; and that the plastic magnet shaped of the inventive plastic magnet composition is free from the decrease of the magnetic properties in the lapse of time and imparted with an extended durability of the product. Accordingly, the present invention provides a possibility of industrial production of high-performance plastic magnets with remarkably reduced production costs on the base of a metallic or alloy-type magnet powder or, in particular, a rare earth-cobalt based magnet powder.

In the following, examples are given to illustrate the present invention in more detail.

Example 1

Into a weighing bottle of about 20 ml capacity was taken an exactly weighed amount of about 2 g of a powder of a rare earth-cobalt magnet alloy SEREM R-22 (a product by Shin-Etsu Chemical Co.) having an average particle diameter of about 2 μm as determined by the Fischer's method. Separately, several solutions each containing 0.5% by weight of a phosphorus-containing compound indicated in Table 1 were prepared and a calculated volume of each solution was added to the magnet powder in the weighing bottle to uniformly wet the powder with agitation followed by drying with heating at 60° C. to evaporate the solvent and then a heat treatment at 110° C. for 1 hour. The coating amount of the phosphorus-containing compound on the magnet powder was as shown in Table 1.

The magnetic powder thus coated on the surface with the phosphorus-containing compound was subjected to a heat treatment at 250° C. for 20 minutes in an air-circulating oven with an object to examine the resistance against air oxidation. The results are given in Table 1 by the value of % increase in the weight before and after the 250° C. heat treatment based on the amount of the uncoated magnet powder. Table 1 also includes the comparative results obtained by use of N-(2-aminoethyl)-3-aminopropyl trimethoxy silane (referred to as Silane KBM 603 in the table) or isopropyl triisostearoyl titanate (referred to as Titanate KR-TTS in the table) each known as a conventional surface-treatment agent for inorganic materials in composite materials of a plastic and an inorganic material as the coating agent in place of the phosphorus-containing compound. Further, the magnet powder was provided with a resin coating by use of an epoxy resin. That is, the magnet powder was uniformly coated with a blend of Epikote 828 (a product by Shell Chemical Co.) and Cemedyne C in amounts of 3% and 2% by weight, respectively, followed by curing with heating at 150° C. for 1 hour and the thus resin-coated magnet powder was subjected to the same air oxidation test as above to give the result shown in Table 1.

TABLE 1

| Coating agent | Solvent | Amount of coating, % by weight | Weight increase by 250° C. heating, % by weight |
|---|---|---|---|
| None | — | — | 15.0 |
| Silane KBM 603 | Toluene | 0.3 | 3.5 |
| Titanate KR-TTS | Toluene | 0.4 | 4.6 |
| Epoxy resin | Toluene | 5.5 | 3.0 |
| Phosphoric acid | Water | 0.5 | 0.8 |
| Sodium dihydrogen-phosphate | Water | 0.5 | 0.3 |
| Phosphorous acid | Water | 0.5 | 0.9 |
| Sodium hypophosphite | Water | 0.5 | 0.7 |
| Sodium pyrophosphate | Water | 0.5 | 0.5 |
| Sodium tripolyphos-phate | Water | 0.5 | 0.6 |
| Potassium pyrophos-phate | Water | 0.5 | 0.3 |
| Sodium hydrogen-metaphosphate | Water | 0.5 | 0.5 |
| IPPT* | n-Hexane | 0.5 | 0.7 |
| Phytic acid | Water | 0.5 | 0.3 |

*Isopropyl tris(dioctyl pyrophosphate) titanate

As is clear from the results shown in Table 1, the coating treatment with the phosphorus-containing compound is very effective in preventing the air oxidation of the magnet powder and the effect is much more remarkable than with the conventional surface-treatment agents and coating resins.

Example 2

Coating treatment of the same magnet powder as in Example 1 was undertaken in substantially the same manner as in Example 1 except that the coating solution contained a phosphorus-containing compound and an organic dye compound as is indicated in Table 2. The coating amounts were 0.2% by weight with the phosphorus-containing compound and 0.3% by weight with the organic dye compound so that the overall coating amount on the magnet powder was 0.5% by weight based on the magnet powder for each of the combinations of the phosphorus-containing compound and the organic dye compound.

The results of the air oxidation test of the thus coated magnet powder given in Table 2 indicate that the oxidation preventing effect of the phosphorus-containing compound is further improved by the combined use thereof with an organic dye compound.

TABLE 2

| Phosphorus-containing compound | Organic dye | Solvent | Weight increase by 250° C. heating, % by weight |
|---|---|---|---|
| Phosphoric acid | C.I. Acid Yellow 114 | Water | 0.4 |
| Sodium dihydrogen-phosphate | C.I. Acid Yellow 114 | Water | 0.2 |
| Phosphoric acid | C.I. Acid Yellow 114 | Water | 0.5 |
| Sodium hypophos-phite | C.I. Acid Yellow 114 | Water | 0.2 |
| Sodium pyrophos-phate | C.I. Direct Blue 202 | Water | 0.3 |
| Sodium tripoly-phosphate | C.I. Sulfur Blue 7 | Water | 0.4 |
| Potassium pyrophos-phate | C.I. Sulfur Blue 7 | Water | 0.3 |
| Sodium hydrogen-metaphosphate | C.I. Acid Yellow 114 | Water | 0.2 |
| IPPT* | C.I. Solvent Black 7 | n-Hexane | 0.6 |

TABLE 2-continued

| Phosphorus-containing compound | Organic dye | Solvent | Weight increase by 250° C. heating, % by weight |
|---|---|---|---|
| Phytic acid | C.I. Solvent Black 7 | Methyl alcohol | 0.2 |
| Phytic acid | C.I. Disperse Yellow 1 | Acetone | 0.4 |
| Phosphoric acid | C.I. Solvent Black 7 | Toluene | 0.4 |

*See footnote to Table 1.

Example 3

A 1 kg portion of a rare earth-cobalt magnet powder SEREM-28 (a product by Shin-Etsu Chemical Co.) was admixed with a 0.5% by weight aqueous solution of a phosphorus-containing compound indicated in Table 3 in a volume to give an amount of the compound equal to 0.5% by weight of the magnet powder and the magnet powder uniformly wetted with the solution under agitation was first heated to 60° C. to evaporate the water and then subjected to a heat treatment at 110° C. for 1 hour.

Each of the thus coated magnet powders in an amount of 435 g was admixed at room temperature with 65 g of a nylon resin (UBE Nylon 12P-3014U, a product by Ube Kosan Co.) and then uniformly blended together in a mixer (Model S-300CH, manufactured by Bravender Co.) with the jacket kept at 200° C. followed by granulation.

In Experiments No. 2 and No. 10 to No. 25 shown in Table 3, the magnet powder before (No. 2) or after (No. 10 to No. 25) the coating treatment with the phosphorus-containing compound was admixed with a 1% by weight toluene solution of an organopolysiloxane compound indicated in the table in a volume to give an amount of the organopolysiloxane equal to 0.5% (No. 2) or 0.4% (the other experiments) by weight of the magnet powder and the magnet powder uniformly wetted with the toluene solution was dried by heating at 110° C. for 30 minutes followed by blending with the nylon resin and granulation in the same manner as described above.

Each of the thus prepared granulated plastic magnet compositions was subjected to the injection molding test by use of a molding machine for injection in a magnetic field (Model TL-50MGS, manufactured by Tanabe Kogyo Co.) to examine the ignition of the composition by injection into open air under the following conditions of injection. Table 3 below gives the results of the time taken before the ignition taking place on the composition as well as the magnetic properties of the thus injection-molded plastic magnets.

Conditions of injection molding:

| | |
|---|---|
| temperature of the cylinder $C_1$ (hopper-side) | 210° C. |
| $C_2$ (nozzle-side) | 300° C. |
| temperature of the nozzle | 290° C. |
| temperature of the metal mold | 110° C. |
| revolution of the screw (load-free condition) | 300 rpm |
| magnetic field for orientation | 21 kOe |

As is clear from the results shown in Table 3, the coating treatment of the magnet powder with the phosphorus-containing compound was quite effective in retarding the ignition of the composition in comparison with the similar compositions in which the magnet powder was provided with no coating layer at all. The results of Table 3 also indicate that the coating treatment with an organopolysiloxane compound following the coating with the phosphorus-containing compound was effective in decreasing the load on the injection machine as is shown by the increased screw revolution as well as in improving the magnetic squareness of the plastic magnet.

Example 4

The same magnet powder as used in Example 3 was subjected to a two step coating treatment first with sodium dihydrogenphosphate to give a coating amount of 0.1% by weight and then with KP 358 (see Example 3) to give a coating amount of 0.4% by weight. The procedure for the coating treatment was substantially the same as in Experiments No. 10 to No. 25 in Example 3.

TABLE 3

| Exp. No. | Surface coating (coating amount, % by weight): Phosphorus-containing compound | Surface coating (coating amount, % by weight): organopolysiloxane | Screw rotation in injection, r.p.m. | Time to ignition, seconds | Properties of plastic magnet: $B_r$ kG | $_iH_c$ kOe | $(BH)_{max}$ MGOe | Orientation, $B_r/B_{r0}$ | Squareness $(BH)_{max}/(B_r/2)^2$ |
|---|---|---|---|---|---|---|---|---|---|
| 1 | None | None | 250 | 0–1 | 4.2 | 6.5 | 2.8 | 0.90 | 0.63 |
| 2 | None | KF 96(a) (0.05) | 280 | 1–5 | 4.4 | 6.9 | 4.0 | 0.95 | 0.83 |
| 3 | Phosphoric acid (0.5) | None | 260 | 5–7 | 4.3 | 6.9 | 4.1 | 0.93 | 0.89 |
| 4 | Sodium dihydrogenphosphate (0.5) | None | 270 | 7–8 | 4.4 | 6.9 | 4.4 | 0.95 | 0.91 |
| 5 | Sodium pyrophosphate (0.5) | None | 260 | 7–8 | 4.3 | 6.9 | 4.2 | 0.92 | 0.91 |
| 6 | Potassium pyrophosphate (0.5) | None | 260 | 7–8 | 4.3 | 6.9 | 4.2 | 0.93 | 0.91 |
| 7 | Sodium hydrogenmetaphosphate (0.5) | None | 260 | 7–8 | 4.3 | 6.9 | 4.2 | 0.93 | 0.91 |
| 8 | Phytic acid (0.5) | None | 260 | 7–8 | 4.3 | 6.9 | 4.2 | 0.93 | 0.91 |
| 9 | IPPT (0.5) | None | 270 | 6–8 | 4.4 | 6.9 | 4.2 | 0.95 | 0.87 |
| 10 | Phosphoric acid (0.2) | KF 96(a) (0.4) | 290 | No ignition | 4.5 | 7.0 | 4.5 | 0.97 | 0.89 |
| 11 | Sodium dihydrogenphosphate (0.2) | KF 96(a) (0.4) | 290 | No ignition | 4.5 | 7.0 | 4.6 | 0.97 | 0.91 |
| 12 | Sodium pyrophosphate (0.2) | KF 96(a) (0.4) | 290 | No ignition | 4.5 | 7.0 | 4.5 | 0.97 | 0.89 |
| 13 | Phytic acid (0.2) | KF 96(a) (0.4) | 290 | No ignition | 4.5 | 7.0 | 4.5 | 0.97 | 0.89 |
| 14 | IPPT (0.2) | KF 96(a) (0.4) | 290 | No ignition | 4.4 | 7.0 | 4.5 | 0.97 | 0.89 |
| 15 | Sodium dihydrogenphosphate (0.2) | KP 358 (0.4) | 290 | No ignition | 4.5 | 7.0 | 4.6 | 0.97 | 0.91 |
| 16 | Sodium dihydrogenphosphate (0.1) | KP 358 (0.4) | 290 | No ignition | 4.5 | 7.0 | 4.6 | 0.97 | 0.91 |
| 17 | Sodium dihydrogenphosphate (0.02) | KP 358 (0.4) | 290 | No ignition | 4.4 | 6.9 | 4.3 | 0.95 | 0.89 |
| 18 | Phytic acid (0.1) | KP 358 (0.4) | 290 | No ignition | 4.5 | 7.0 | 4.6 | 0.97 | 0.91 |
| 19 | IPPT (0.1) | KP 358 (0.4) | 290 | No ignition | 4.5 | 7.0 | 4.6 | 0.97 | 0.91 |
| 20 | Phosphoric acid (0.2) | KF 96(b) (0.4) | 290 | No ignition | 4.5 | 6.9 | 4.6 | 0.97 | 0.89 |
| 21 | Sodium diphydrogenphosphate (0.2) | KF 96(b) (0.4) | 290 | No ignition | 4.5 | 7.0 | 4.6 | 0.97 | 0.91 |
| 22 | Phosphoric acid (0.2) | KF 96(c) (0.4) | 290 | No ignition | 4.5 | 7.0 | 4.6 | 0.97 | 0.91 |
| 23 | Phosphoric acid (0.2) | KR 275 (0.4) | 290 | No ignition | 4.5 | 7.0 | 4.6 | 0.97 | 0.91 |
| 24 | Sodium dihydrogenphosphate (0.2) | KR 275 (0.4) | 290 | 2–4 | 4.5 | 7.0 | 4.6 | 0.97 | 0.91 |
| 25 | Phytic acid (0.2) | KR 275 (0.4) | 290 | No ignition | 4.5 | 7.0 | 4.5 | 0.97 | 0.91 |

In Table 3 and hereinafter, each of the organopolysiloxane compounds is shown by the abridged notation having the following meaning. All of these organopolysiloxane compounds are the products by Shin-Etsu Chemical Co.

KF 96(a): a dimethylsilicone fluid having a viscosity of 100 centipoise at 25° C.

KF 96(b): a dimethylsilicone fluid having a viscosity of 1000 centipoise at 25° C.

KF 96(c): a dimethylsilicone fluid having a viscosity of 1,000,000 centipoise at 25° C.

KP 358: a modified silicone fluid

The thus surface-coated magnet powder was blended with the same nylon resin as used in Example 3 in a varied proportion to give the magnet powder loading in % by weight as indicated in Table 4 to give plastic magnet compositions to be subjected to the injection molding test in the same manner as in Example 3. The results were as shown in Table 4 which also gives the comparative results obtained in the tests performed with the compositions in which the magnet powder has no coating layer (Experiments No. 26 and No. 27) or a coating layer or KF 96(a) alone in a coating amount of 0.5% by weight (Experiment No. 28). The appearance of the molded magnet pieces was good in all of the experiments excepting No. 27 in which no molded magnet could be obtained.

Example 5

The same magnet powder as used in the preceding example was subjected to the coating treatment first by uniformly wetting with an aqueous coating solution containing a phosphorus-containing compound and an organic dye compound in a volume to give 0.1% by weight of each of the compounds based on the magnet powder followed by drying and then with a 1% by weight toluene solution of an organopolysiloxane compound in a volume to give 0.4% by weight of the organopolysiloxane followed by drying at 60° C. to evaporate the solvent and then a heat treatment at 110° C. for 1 hour. The types of these coating agents are shown in Table 5 below.

In Table 5, Experiments No. 33 and No. 34 were for comparative purpose in which the magnet powder was provided with no coating layer at all (No. 33) or with a coating layer of KF 96(b) alone in a coating amount of 0.5% by weight based on the magnet powder (No. 34). Experiments No. 35 and No. 36 were undertaken also for comparative purpose in which the coating treatment of the magnet powder was performed by use of a coating solution containing the organic dye compound alone to give a coating amount of 0.25% by weight based on the magnet powder.

Example 6

The same magnet powder as in the preceding example surface-coated with the same coating agents and under the same conditions as in Experiment No. 41 in Example 5 was blended with the same nylon resin in varied proportions to give plastic magnet compositions with different magnet powder loadings indicated in Table 6 below and each of the compositions was subjected to the injection molding test under the same conditions to give the results shown in the table. All of the thus molded plastic magnets have good appearance.

TABLE 4

| Exp. No. | Magnet powder loading, % by weight | Screw rotation in injection, r.p.m. | Time to ignition, seconds | Properties of plastic magnet $B_r$ kG | $_iH_c$ kOe | $(BH)_{max}$ MGOe | Orientation, $B_r/B_{ro}$ |
|---|---|---|---|---|---|---|---|
| 26 | 87 | 250 | 0–1 | 4.2 | 6.5 | 2.8 | 0.9 |
| 27 | 88 | <200 | 0–1 | | | (not moldable) | |
| 28 | 87 | 280 | 1–5 | 4.4 | 6.9 | 4.0 | 0.95 |
| 29 | 87 | 290 | No ignition | 4.5 | 7.0 | 4.6 | 0.97 |
| 30 | 90 | 290 | No ignition | 5.0 | 7.0 | 5.3 | 0.94 |
| 31 | 92 | 280 | No ignition | 5.5 | 6.9 | 6.4 | 0.90 |
| 32 | 94 | 270 | No ignition | 6.0 | 7.0 | 7.5 | 0.87 |

Plastic magnet compositions were prepared in just the same manner as in Example 3 with one of the above obtained surface-coated magnet powders and subjected to the injection molding test also in the same manner as in Example 3 to give the results shown in Table 5.

TABLE 5

| Exp. No. | Surface coating agents: Phosphorus-containing compound and organic dye | Surface coating agents: Organopolysiloxane | Screw rotation in injection, r.p.m. | Time to ignition, seconds | Properties of plastic magnet $B_r$ kG | $_iH_c$ kOe | $(BH)_{max}$ MGOe | Orientation, $B_r/B_{radio}$ | Squareness $(BH)_{max}/(B_r/2)^2$ |
|---|---|---|---|---|---|---|---|---|---|
| 33 | None | None | 250 | 0–1 | 4.2 | 6.5 | 2.8 | 0.90 | 0.63 |
| 34 | None | KF 96(b) (0.5) | 280 | 1–5 | 4.4 | 6.9 | 4.0 | 0.95 | 0.83 |
| 35 | C.I. Acid Yellow 114 | None | 260 | 5–7 | 4.4 | 7.0 | 4.0 | 0.95 | 0.83 |
| 36 | C.I. Solvent Black 7 | None | 250 | 2–4 | 4.4 | 6.9 | 3.8 | 0.95 | 0.79 |
| 37 | Sodium dihydrogenphosphate | None | 250 | No ignition | 4.4 | 7.0 | 4.1 | 0.95 | 0.85 |
| 38 | Sodium dihydrogenphosphate C.I. Solvent Black 7 | None | 250 | No ignition | 4.4 | 7.0 | 4.1 | 0.95 | 0.85 |
| 39 | Phytic acid C.I. Solvent Black 7 | None | 250 | No ignition | 4.4 | 7.0 | 4.1 | 0.95 | 0.85 |
| 40 | IPPT C.I. Solvent Black 7 | None | 260 | No ignition | 4.4 | 7.0 | 4.2 | 0.95 | 0.87 |
| 41 | Sodium dihydrogenphosphate C.I. Acid Yellow 114 | KP 358 | 290 | No ignition | 4.5 | 7.0 | 4.6 | 0.97 | 0.89 |
| 42 | Phytic acid C.I. Solvent Black 7 | KP 358 | 290 | No ignition | 4.5 | 7.0 | 4.5 | 0.97 | 0.89 |
| 43 | IPPT C.I. Solvent Black 7 | KP 358 | 290 | No ignition | 4.5 | 7.0 | 4.5 | 0.97 | 0.89 |

TABLE 6

| Exp. No. | Magnet powder loading, % by weight | Screw rotation in injection, r.p.m. | Time to ignition, seconds | Properties of plastic magnet $B_r$ kG | $_iH_c$ kOe | $(BH)_{max}$ MGOe | Orientation, $B_r/B_{ro}$ |
|---|---|---|---|---|---|---|---|
| 44 | 87 | 290 | No ignition | 4.5 | 7.0 | 4.6 | 0.97 |
| 45 | 90 | 290 | No ignition | 5.0 | 7.0 | 5.4 | 0.94 |
| 46 | 92 | 280 | No ignition | 5.5 | 6.9 | 6.5 | 0.90 |

TABLE 6-continued

| Exp. No. | Magnet powder loading, % by weight | Screw rotation in injection, r.p.m. | Time to ignition, seconds | Properties of plastic magnet | | | |
|---|---|---|---|---|---|---|---|
| | | | | $B_r$ kG | $_iH_c$ kOe | $(BH)_{max}$ MGOe | Orientation, $B_r/B_{ro}$ |
| 47 | 94 | 270 | No ignition | 6.0 | 7.0 | 7.7 | 0.87 |

As is clear from this table, the magnet powder loading could be increased to as high as 94% by weight when the magnet powder was provided with a coating layer using the ternary combination of the phosphorus-containing compound, the organic dye compound and the organopolysiloxane compound to give a plastic magnet having remarkably improved magnetic porperties whereas the magnet powder loading could be 87% or smaller when the magnet powder was uncoated at all or coated with an organopolysiloxane compound alone.

What is claimed is:

1. A plastic magnet composition which comprises:

(a) a thermoplastic resin as a binder: and (b) a powder of a metallic or alloy magnet having a coating layer on the surface of the particles formed of a phosphorus-containing compound having at least one phosphorus-to-oxygen linkage in a molecule and uniformly blended with the thermoplastic resin.

2. The plastic magnet composition as claimed in claim 1 wherein the coating layer on the surface of the particles of the powder of a metallic or alloy magnet is formed of a combination of the phosphorus-containing compound and an organic dye compound.

3. The plastic magnet composition as claimed in claim 1 wherein the coating layer on the surface of the particles of the powder of a metallic or alloy magnet is formed of a combination of the phosphorus-containing compound and an organopolysiloxane compound.

4. The plastic magnet composition as claimed in claim 2 wherein the coating layer on the surface of the particles of the powder of a metallic or alloy magnet is formed of a combination of the phosphorus-containing compound, the organic dye compound and an organopolysiloxane compound.

5. The plastic magnet composition as claimed in claim 3 wherein the coating layer on the surface of the particles of the powder of a metallic or alloy magnet is composed of an undercoating layer formed of the phosphorus-containing compound and an overcoating layer formed of the organopolysiloxane compound.

6. The plastic magnet composition as claimed in claim 4 wherein the coating layer on the surface of the particles of the powder of a metallic or alloy magnet is composed of an undercoating layer formed of the phosphorus-containing compound and the organic dye compound and an overcoating layer formed of the organopolysiloxane compound.

7. The plastic magnet composition as claimed in claim 1 wherein the amount of the phosphorus-containing compound is in the range from 0.01 to 5% by weight based on the powder of the metallic or alloy magnet.

8. The plastic magnet composition as claimed in claim 1 wherein the phosphorus-containing compound is selected from the group consisting of phosphoric acid, sodium dihydrogen-phosphate, phosphorous acid, sodium hypophosphite, sodium pyrophosphate, potassium pyrophosphate, sodium tripolyphosphate, sodium hydrogenmetaphosphate, isopropyl tris(dioctyl pyrophosphate) titanate and phytic acid.

* * * * *